United States Patent [19]

Fagg et al.

[11] Patent Number: 4,967,771

[45] Date of Patent: Nov. 6, 1990

[54] PROCESS FOR EXTRACTING TOBACCO

[75] Inventors: Barry S. Fagg, Winston-Salem, N.C.; James D. Fredrickson, deceased, late of Winston-Salem, N.C., by Agnes C. Fredrickson, administrator

[73] Assignee: R. J. Reynolds Tobacco Company, Winston-Salem, N.C.

[21] Appl. No.: 280,861

[22] Filed: Dec. 7, 1988

[51] Int. Cl.[5] ..... A24B 15/24; A24B 15/26

[52] U.S. Cl. ..... 131/297; 131/298

[58] Field of Search ..... 131/297, 298

[56] References Cited

U.S. PATENT DOCUMENTS

| | | | |
|---|---|---|---|
| 283,622 | 8/1983 | Liebreich et al. . | |
| 802,487 | 10/1905 | Wimmer | 131/297 |
| 1,671,259 | 5/1928 | Schloesing . | |
| 1,949,012 | 2/1934 | Frank . | |
| 2,227,863 | 1/1941 | Rhodes . | |
| 2,805,667 | 9/1957 | Von Bethmann . | |
| 2,995,476 | 8/1961 | Hind et al. . | |
| 3,046,997 | 7/1962 | Hind | 131/298 |
| 3,139,435 | 6/1964 | Staley et al. . | |
| 3,147,199 | 10/1964 | Neel . | |
| 3,147,200 | 10/1964 | Neel . | |
| 3,151,118 | 10/1964 | Moser . | |
| 3,177,196 | 4/1965 | Scheibel . | |
| 3,390,685 | 7/1968 | Von Bethmann | 131/298 |
| 3,396,735 | 8/1968 | Von Bethmann et al. . | |
| 3,612,066 | 10/1971 | Jones et al. . | |
| 4,260,836 | 4/1981 | Levy . | |

FOREIGN PATENT DOCUMENTS

| | | |
|---|---|---|
| 280817 | 9/1988 | European Pat. Off. . |
| 72/3935 | 6/1972 | South Africa . |

OTHER PUBLICATIONS

*Industrial and Engineering Chemistry*, Claffey et al., vol. 42, pp. 166–171 (1950).

A.I.Ch.E. Journal, Karr, vol. 5, pp. 446–452 (1959).

*Primary Examiner*—V. Millin

[57] ABSTRACT

Tobacco extracts are provided by first extracting tobacco material with water and then subjecting the resulting aqueous tobacco extract to a liquid/liquid extraction process using a halocarbon or a halogenated hydrocarbon. Preferably, the pH of the aqueous extract is adjusted to about 9 or above prior to the liquid/liquid extraction step. The two immiscible solvents then are separated from one another such that there is provided an aqueous tobacco extract having certain extracted tobacco components removed therefrom and halocarbon or halogenated hydrocarbon solvent having extracted tobacco components carried thereby. The processed aqueous extract can be spray dried to provide a concentrated tobacco extract which then can be employed as a flavoring agent for cigarettes and other smoking articles. Tobacco components carried by the halocarbon or halogenated hydrocarbon solvent also can be separated from that solvent.

60 Claims, 2 Drawing Sheets

PROCESS FOR EXTRACTING TOBACCO

BACKGROUND OF THE INVENTION

The present invention relates to tobacco extracts, and in particular to processes for providing tobacco extracts having certain amounts of selected components removed therefrom.

Popular smoking articles such as cigarettes have a substantially cylindrical rod shaped structure and include a charge of smokable material such as shreds or strands of tobacco (i.e., cut filler) surrounded by a wrapper such as paper thereby forming a tobacco rod. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

Tobacco undergoes various processing steps prior to the time that it is used for cigarette manufacture. Oftentimes, tobacco is chemically or physically treated to increase the flavor and improve the smoking characteristics of the tobacco. In certain circumstances, it may be desirable to selectively remove components such as nicotine from tobacco as well as from processed forms of tobacco such as tobacco extracts. Various processes directed toward removing nicotine from tobacco have been proposed. Many of such types of processes are discussed in European Patent Application No. 280817 to Grubbs et al.

It would be desirable to provide a process for efficiently and effectively processing tobacco extracts so as to remove selected components therefrom.

SUMMARY OF THE INVENTION

The present invention relates to a process for providing a refined tobacco extract, and in particular to a tobacco extract having significant amounts of certain components removed therefrom. The present invention also relates to a process for providing extracted tobacco components which have been removed from an extract of tobacco. The process involves extracting various components from tobacco material using a first liquid solvent. The resulting extracted components carried by or provided within the first solvent are contacted with a second liquid solvent which is immiscible with the first solvent. Some of the tobacco components within the first solvent are transferred to within the second solvent, and the first and second solvents are separated from one another. The extracted tobacco components within the first and second solvents then can be isolated from the respective solvents.

More particularly, the process of the present invention involves extracting components from tobacco material using a first solvent having an aqueous character. As such, an aqueous tobacco extract and a water insoluble tobacco portion are provided. A significant portion of the aqueous extract is separated from the insoluble portion. The aqueous extract then is contacted with a second solvent which is immiscible with the first solvent, and which exhibits a density different from the first solvent. For example, when the first solvent is water, a second solvent such as monofluorotrichloromethane or dichlorotrifluoroethane is immiscible in water, and has a density substantially different from that of water. Depending upon the manner in which the aqueous extract is treated prior to the time that contact with the second solvent is effected, selected components of the aqueous extract are removed by the second solvent. For example, an aqueous tobacco extract which is adjusted to a pH of about 9 or above can have substantially all of the nicotine thereof removed using a second solvent which is a good solvent for nicotine. After contact of the aqueous extract and the second solvent has occurred for the desired period of time, the aqueous extract and the second solvent are separated from one another. As such, an aqueous extract having a very low amount of nicotine is separated from the second solvent which contains the nicotine extracted from the aqueous tobacco extract. The tobacco components contained within either or both of the first and second solvents then can be isolated from the first and second solvents, respectively.

The process of the present invention provides the skilled artisan with an efficient and effective method for removing and isolating selected tobacco components of an aqueous extract of tobacco. For example, an aqueous extract of tobacco having a pH of about 7 or above can be subjected to a liquid/liquid extraction process using a halogenated hydrocarbon as a second solvent so as to remove a significant portion of nicotine and other alkaloids from the aqueous extract, while leaving many of the other flavorful tobacco components present within the aqueous solvent. Preferred processes for denicotinizing aqueous tobacco extracts according to the present invention provide for the removal of greater than about 90 weight percent, preferably greater than about 95 weight percent of the nicotine present within the aqueous extract.

DETAILED DESCRIPTION OF THE PREFERRED EMBODIMENTS

Figure 1:
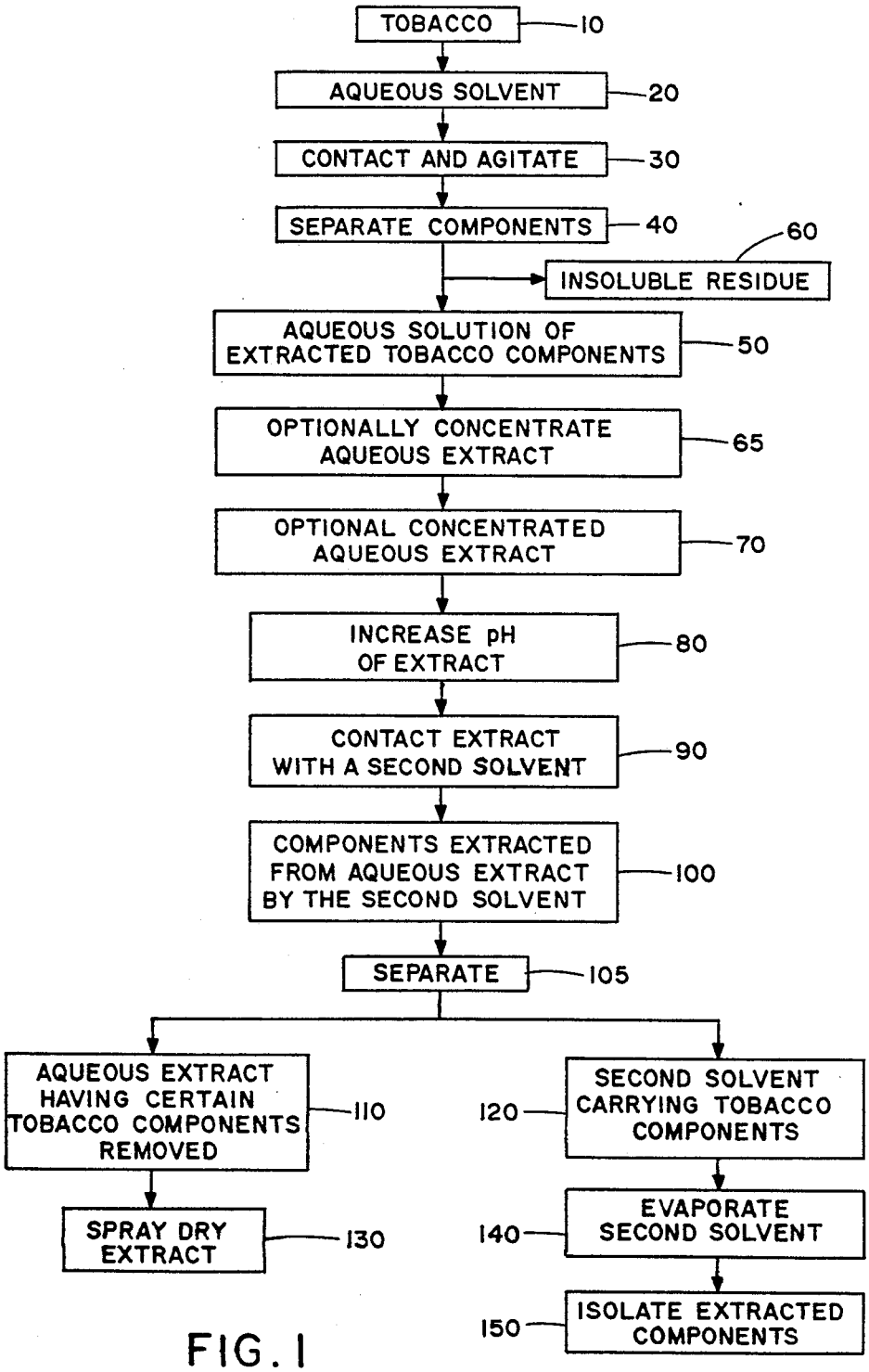
FIG. 1 is a schematic diagram of the process steps representative of one embodiment of this invention.

Referring to FIG. 1, tobacco material 10 is contacted with an aqueous solvent 20. The resulting mixture is stirred or otherwise agitated using a suitable agitation means 30. As a result, water soluble components are extracted from the tobacco by the solvent. The mixture is subjected to separation conditions 40 so as to provide a solution 50 of water soluble tobacco components (i.e., an aqueous tobacco extract) and a water insoluble residue 60. Optionally, the aqueous tobacco extract 50 then is concentrated 65 to an appropriate dissolved solids level using a thin film evaporator, or the like, such that a concentrated liquid tobacco extract 70 is obtained.

The liquid extract 70, which normally exhibits a pH below about 6, is contacted with a base 80 such as gaseous ammonia, an aqueous solution ammonium hydroxide or solid potassium hydroxide to increase the pH of the extract to about 9 or above. The liquid extract having an increased pH is contacted with a second solvent 90 such as monofluorotrichloromethane. Tobacco components dissolved within the aqueous solvent are extracted 100 by the second solvent. The two solvents then are separated 105 thereby yielding (i) an aqueous tobacco extract 110 having significant amounts of certain tobacco components (e.g., nicotine) removed therefrom, (ii) and a second solvent 120 carrying certain tobacco components (e.g., nicotine) soluble therein and which are extracted from the aqueous extract. The aqueous extract can be isolated, for example, by spray drying 130 the extract to yield a processed, tobacco extract powder. The second solvent can be evaporated 140 to isolate the components 150 extracted thereby. The second solvent then can be reused for further liquid/liquid extraction processing steps.

Figure 2:
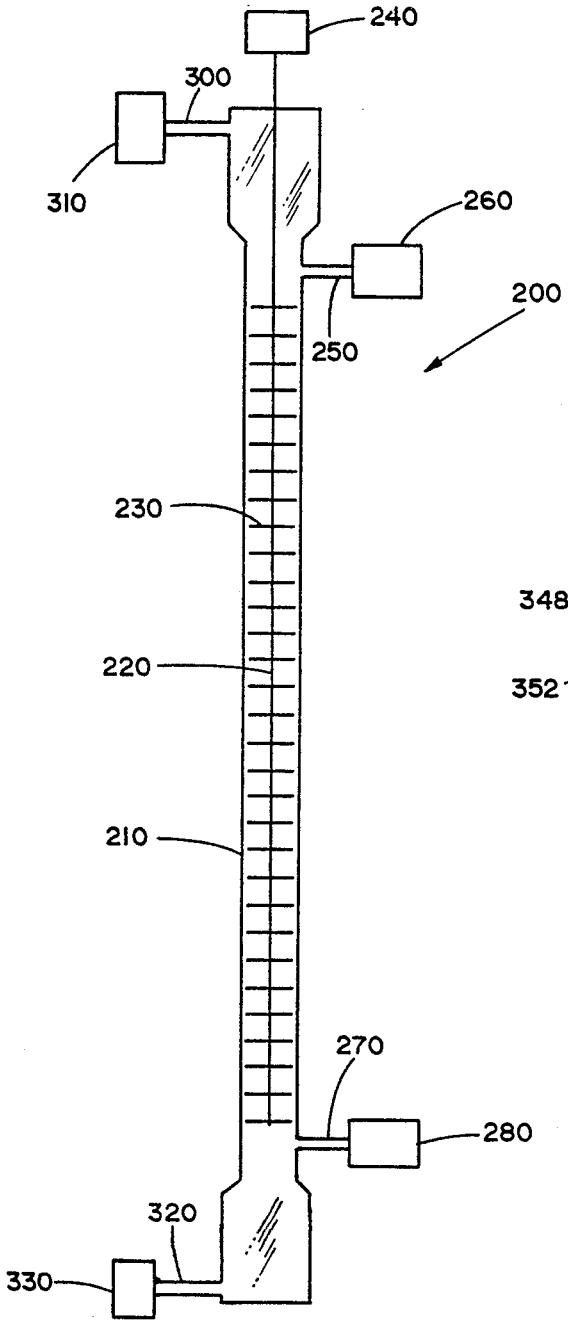
FIG. 2 is a schematic diagram of a representative apparatus for performing the process of this invention.

Referring to FIG. 2, an apparatus 200 for performing a liquid/liquid extraction process is shown. Such an apparatus is known to the skilled artisan as a Karr Reciprocating Plate Extraction Column. See, Karr, *A. I. Ch. E. Journ.*, Vol. 5, p. 446 (1959). The apparatus includes a long, slender tube or column 210 which is positioned such that the longitudinal axis thereof is in an essentially vertical plane. Essentially coaxially with the longitudinal axis of the column is inserted a shaft 220 which supports a plurality of extraction plates 230 spaced at intervals along the shaft. The plates 230 preferably are positioned perpendicularly to the shaft 220. The shaft is supported by a variable speed drive agitator 240 or other such means which moves the shaft (and hence the series of plates) periodically up and down. The column 210 includes an upper input region or nozzle 250 into which the second (e.g., heavy) solvent is fed continuously from source 260. The column also includes lower input region 270 or nozzle into which the first solvent containing extracted tobacco components are fed continuously from source 280.

The shaft 220 (and hence the plates 230) is reciprocated at a rate sufficient to provide adequate contact of the two solvents but at a sufficiently low rate so as to minimize or eliminate the formation of an undesirable emulsion of the first and second solvents. The raffinate (i.e., the aqueous tobacco extract which has been contacted with the second solvent) exits the column 210 at output region 300 and is collected in reservoir 310. The second solvent and tobacco components carried thereby and which have been extracted from the first solvent exit the column at output region 320 and are collected in reservoir 330.

Figure 3:
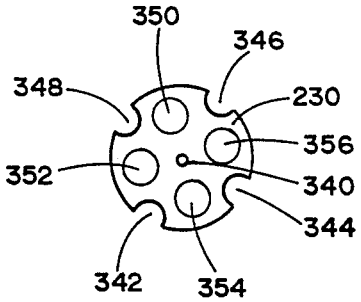
FIG. 3 is an enlarged view of a component of the apparatus shown in FIG. 2.

Referring to FIG. 3, there is shown an end view of a representative extraction plate 230 taken along the longitudinal axis of the column 210. The spacer 230 has a diameter which approximates the inner diameter of the column. The plate has an opening 340, through which the shaft extends. The plate also includes a series of peripheral openings 342, 344, 346 and 348 as well as inner openings 350, 352, 354 and 356, such that the liquid solvents can pass therethrough. Normally, the plate is manufactured from a metal such as stainless steel, a polymeric material such as Teflon, or the like.

The tobacco material can vary. Examples of suitable tobaccos include flue-cured, Burley, Md., and Oriental tobaccos, as well as the rare or specialty tobaccos. The tobacco material can be in the form of laminae and/or stem, or can be in a processed form. Tobacco waste materials and processing by-products such as fines, dust, scrap, stems and stalks can be employed. The aforementioned materials can be processed separately, or as blends thereof.

The tobacco material can have a variety of sizes for the first extraction. For example, the tobacco can be in strip form or cut filler form. Tobacco materials in strip or cut filler form are desirable in that the spent materials which remain after the extraction step can be dried or used as pulp, and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having an aqueous character. Such a solvent consists primarily of water, and can be essentially pure water in certain circumstances. However, the first solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the first solvent can vary. Typically, the weight of first solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 60° C., with about 15° C. to about 30° C. being preferred, and ambient temperature being especially preferred. The solvent/tobacco material mixture can be agitated (e.g., stirred, shaken or otherwise mixed) in order to increase the rate at which extraction occurs. Typically, adequate extraction of components occurs in less than about 60 minutes, oftentimes less than about 30 minutes.

A wide variety of materials or components can be extracted from the tobacco materials. The particular materials and the amounts of the particular materials which are extracted often depend upon the type of tobacco which is processed, the properties of the particular solvent, and the extraction conditions (e.g., which include the temperature at which the extraction occurs as well as the time period over which an extraction is carried out). For example, a first solvent consisting essentially of pure water will most often extract primarily the water soluble components of the tobacco material, while a co-solvent mixture of water and a minor amount of an alcohol can extract the water soluble components of the tobacco material as well as certain amounts of components having other solubility characteristics.

The first solvent and extracted components are separated from the insoluble residue. The manner of separation can vary; however, it is convenient to employ conventional separation means such as filtration, centrifugation, or the like. It is desirable to provide a solution of solvent and extracted components having a very low level of suspended solids.

The first solvent and components extracted thereby (e.g., the aqueous tobacco extract) can be concentrated, spray dried, freeze dried, or otherwise processed for storage or handling reasons. Dried materials such as spray dried materials later can be redissolved in the first solvent for later liquid/liquid extraction steps. If desired, the liquid tobacco extract can be subjected to processing conditions so as to denitrate or deproteinate the liquid extract or otherwise chemically or physically alter that extract.

The pH of the first solvent and extracted components can be altered, and typically the pH thereof is altered prior to the time that contact thereof with the second solvent is effected. The pH of the aqueous tobacco extract can be raised to promote removal of basic compounds therefrom, lowered to promote removal of acidic compounds therefrom, or made neutral of promote removal of neutral compounds therefrom. For example, the pH of the aqueous tobacco extract can be raised so as to enhance the removal of alkaloids such as nicotine therefrom upon contact with the second solvent. Typically, for certain processes, the pH of the first solvent and extracted components is altered so as to be about 7 or more, frequently about 8 or more, and occasionally about 9 or more. It may be desirable to alter the pH of an aqueous tobacco extract, perform a liquid/liquid extraction step, collect the resulting aqueous phase, alter the pH of that aqueous phase, and perform a second liquid/liquid extraction step. Agents for altering the pH of the first solvent and extracted components will be apparent to the skilled artisan.

The amount of extracted tobacco components relative to the amount of first solvent during the liquid/liquid extraction step with the second solvent can vary. Although highly concentrated extracts can be employed, typically, the dissolved tobacco components present within the first solvent are less than about 25 weight percent, normally less than about 10 weight percent, and frequently about 5 weight percent or less.

The second solvent, can vary. Preferably, the second solvent is a halocarbon or a halogenated hydrocarbon such as monofluorotrichloromethane (Freon 11), dichlorotrifluoroethane (Freon 123), and the like. Alternatively, second solvents include the triglycerides. Triglyceride compounds include palm oil, linseed oil, soybean oil, corn oil, and the like. Preferred solvents have densities which are substantially different from that of the first solvent. For example, it is desirable that the density of the second solvent differ from the first solvent by more than about 20 percent, preferably more than 30 percent, more preferably more than about 40 percent.

The first and second solvents are immiscible with one another. By this is meant that the two solvents do not have a propensity to mix with one another and remain in distinct phases upon contact. Preferably, when the first and second solvents are contacted with one another under conditions at which the liquid/liquid extraction steps are performed, the two solvents do not emulsify to any significant degree. For many immiscible solvents useful according to this invention, the solubility of the second solvent in the first solvent normally is less than about 1 weight percent, and more preferably less than about 0.5 weight percent, at 25° C., although immiscible solvents having higher solubilities in one another can be employed.

The first solvent and components therewithin are contacted with the second solvent. Normally, the temperature of the column are controlled so that both of the first and second solvents remain in liquid form during the period of contact with one another. For example, it is desirable to maintain the first and second solvents at a temperature below about 30° C. at atmospheric pressure during the time that the first and second solvents are in contact, particularly when the second solvent is Freon 11 or Freon 123. Typically, the temperature at which the liquid/liquid extraction is performed is high enough to minimize or eliminate the formation of an emulsion but low enough to minimize or eliminate the vaporization of either or both of the solvents.

The first and second solvents are subjected to conditions sufficient to transfer some tobacco components from within the first solvent to within the second solvent. For example, certain extracted tobacco components which are carried by the first solvent may have a preferential solubility in the second solvent. In particular, when the first solvent is water and the aqueous tobacco extract has a pH of about 9 or more, a large portion of the nicotine and other alkaloids present within the aqueous extract are preferentially soluble in a second solvent such as a halogenated hydrocarbon.

After contact of the first and second solvents is effected, the respective solvents are separated from one another. Preferably, the contact of the solvents occurs for a period of time sufficient to provide transfer of a significant amount of the desired tobacco components from the first solvent to the second solvent. Additionally, it is preferable that agitation of the solvents during contact thereof be such that emulsification be minimized or eliminated. Typically, when a Karr Reciprocating Plate Extraction Column is employed to perform the liquid/liquid extraction process, the first solvent (e.g., the solvent carrying extracted tobacco components which remain after contact with the second solvent) exits the upper output region of the column and is collected; and the second solvent (e.g., the denser solvent carrying certain extracted tobacco components removed from the first solvent) exits the lower output region of the column and is collected. Other apparatus for contacting and separating the two solvents and tobacco components extracted thereby (e.g., separation funnels, centrifugal extractors and rotating disc columns) will be apparent to the skilled artisan.

The tobacco components which are carried by the second solvent after the liquid/liquid extraction process normally are separated from the second solvent (i.e., isolated). Typically, the second solvent is distilled and the tobacco components contained therein are collected. Alternatively, when the second solvent has been used to extract nicotine from the tobacco components within the first solvent, the second solvent can be subjected to a liquid/liquid extraction process with an acidified aqueous solution to remove the nicotine from the second solvent. The second solvent, essentially absent of any tobacco components, then can be re-employed as a solvent for further liquid/liquid extraction processing steps.

The tobacco components which remain within the first solvent after the liquid/liquid extraction process can be employed as is, concentrated and employed, or separated from the first solvent (i.e., isolated). For example, the liquid which is collected after the liquid/liquid extraction process can be freeze dried, spray dried, or the like, so that a great majority of the first solvent is removed therefrom. As such, concentrated tobacco extracts in stabilized form can be provided.

The processed extracts within each of the first and second solvents and the concentrated extracts often are useful as flavoring agents for cigarettes and other smoking articles. For example, the concentrated extracts can be employed as casing or top dressing components during the preparation of smokable cut filler for the manufacture of cigarettes. As another example, the processed tobacco extracts can be applied to the spent materials from the first stage extraction, particularly after the spent materials have been formed into a sheet-like mat using papermaking techniques. The resulting smokable materials can be used in cigarette manufacture.

Alternatively, the processed extracts and concentrated extracts can be employed as flavoring agents in those smoking articles described in U.S. Pat. Nos. 4,708,151 to Shelar; 4,714,082 to Banerjee et al; and 4,756,318 to Clearman et al.

The following examples are provided in order to further illustrate various embodiments of the invention but should not be construed as limiting the scope thereof. Unless otherwise noted, all parts and percentages are by weight.

EXAMPLE 1

A flue-cured tobacco in cut filler form and having a nicotine content of about 4 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 5 percent to about 6 percent, and a nicotine content of about 8.5 percent.

The spray dried extract is contacted with water at ambient temperature in the amount of 4 parts extract to 96 parts water. A solution of water soluble tobacco extract in water is provided and exhibits a pH of about 5. To the solution is added a sufficient amount of a solution of ammonium hydroxide in water to provide an aqueous tobacco extract exhibiting a pH of about 9.

A Karr Reciprocating Plate Extraction Column as shown generally in FIG. 2 is provided. The column is a Model KC-1-8-XE-SS from Chem-Pro Corp., Fairfield, N.J. The column includes a glass tube having a length of about 96 inches and an inner diameter of about 1 inch. Through the column extends a shaft having a diameter of about 6 mm. On the shaft is positioned about 48 generally circular extraction plates at about 2 inch intervals. The plates are manufactured from stainless steel, have a thickness of about 1/16 inch, have a diameter of slightly less than 1 inch, and have the shape and configuration shown generally in FIG. 3. The movement of the shaft is controlled at a reciprocation of 70 strokes per minute and a reciprocation aptitude of 1.75 inch by a variable speed drive agitator positioned above the column.

Into the lower input region of the column is fed the aqueous tobacco extract at a rate of about 5.5 pounds per hour. Into the upper input region of the column is fed Freon 11 at a rate of about 37.5 pounds per hour. Feed of each of the aqueous tobacco extract and the Freon 11 is provided by air driven gear pumps. The Freon 11 and the aqueous extract each are chilled to about 12° C. prior to introduction into the column. In addition, a water cooled coil which surrounds the column maintains the column at a temperature of about 14° C. The aqueous tobacco extract and the Freon 11 are subjected to a countercurrent extraction process.

The aqueous extract is removed from the column at the upper output region, and collected in a stainless steel reservoir. The Freon 11 is removed from the column at the lower output region, and is collected in a stainless steel reservoir.

The aqueous extract is spray dried in a manner similar to the previously described spray drying process. The nicotine content of the spray dried extract is about 0.1 percent. By difference, the nicotine extraction efficiency is above 98 percent.

The Freon 11 and tobacco components extracted thereby are subjected to mild distillation conditions at about 30° C., and the Freon 11 distillate is collected. A brown liquid of high viscosity and containing over 60 percent nicotine is isolated.

COMPARATIVE EXAMPLE

A flue-cured tobacco in cut filler form and having a nicotine content of about 3 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 5 percent to about 6 percent, and a nicotine content of about 6 percent.

The spray dried extract is contacted with water at ambient temperature in the amount of 10 parts extract to 90 parts water. A solution of water soluble tobacco extract in water is provided and exhibits a pH of about 5. The nicotine content of the solution is about 0.59 percent.

A Karr Reciprocating Plate Extraction Column as shown generally in FIG. 2 is provided. The column is a Model KC-1-8-XE-SS from Chem-Pro Corp., Fairfield, N.J. The column includes a glass tube having a length of about 96 inches and an inner diameter of about 1 inch. Through the column extends a shaft having a diameter of about 6 mm. On the shaft is positioned about 48 generally circular extraction plates at about 2 inch intervals. The plates are manufactured from stainless steel, have a thickness of about 1/16 inch, have a diameter of slightly less than 1 inch, and have the shape and configuration shown generally in FIG. 3. The movement of the shaft is controlled at a reciprocation of 70 strokes per minute and a reciprocation aptitude of 1.75 inch by a variable speed drive agitator positioned above the column.

Into the lower input region of the column is fed the aqueous tobacco extract at a rate of about 12.5 pounds per hour. Into the upper input region of the column is fed Freon 11 at a rate of about 31.3 pounds per hour. Feed of each of the aqueous tobacco extract and the Freon 11 is provided by air driven gear pumps. The Freon 11 and the aqueous extract each are chilled to about 12° C. prior to introduction into the column. In addition, a water cooled coil which surrounds the column maintains the column at a temperature of about 14° C. The aqueous tobacco extract and the Freon 11 are subjected to a countercurrent extraction process.

The aqueous extract is removed from the column at the upper output region, and collected in a stainless steel reservoir. The nicotine content of the aqueous extract is about 0.57 percent.

The Freon 11 and the tobacco components extracted thereby are removed from the column at the lower output region, and collected in a stainless steel reservoir. The Freon 11 and tobacco components extracted thereby are subjected to mild distillation conditions at about 30° C., and the Freon 11 distillate is collected. A light brown, viscous liquid having a strong tobacco aroma is isolated.

What is claimed is:

1. A process for providing a tobacco extract, the process comprising:

(i) extracting components from tobacco material with a first liquid solvent having an aqueous character, (ii) providing a liquid extract of tobacco within the first solvent and adjusting the pH thereof, (iii) contacting the first solvent and extracted tobacco components therewithin with a second liquid solvent which is immiscible with the first solvent, (iv) subjecting the contacted first and second solvents to conditions sufficient to transfer some tobacco components from with the first solvent to within the second solvent, (v) separating the first and second solvents from one another, and (vi) isolating tobacco components from each of the first and second solvents.

2. The process of claim 1 whereby the first solvent is water.

3. The process of claim 1 whereby the second solvent is a halogenated hydrocarbon.

4. The process of claim 1 whereby the first solvent is a col-solvent mixture.

5. The process of claim 1, 2 or 3 whereby the density of the second solvent is greater than the density of the first solvent.

6. The process of claim 1, 2 or 3 whereby the density of the second solvent differs from the first solvent by more than 20 percent.

7. The process of claim 1, 2 or 3 whereby the density of the second solvent differs from the first solvent by more than 30 percent.

8. The process of claim 1, 2 or 3 whereby the density of the second solvent differs from the first solvent by more than 40 percent.

9. The process of claim 1, 2 or 3 whereby the first and second solvents are subjected to conditions sufficient to transfer tobacco components from within the first solvent to within the second solvent at a temperature less than about 30° C. at atmospheric pressure.

10. The process of claim 1 whereby the amount of extracted tobacco components within the first solvent is less than about 10 weight percent.

11. The process of claim 1 whereby the first and second solvents are subjected to conditions sufficient to transfer tobacco components from within the first solvent to within the second solvent at a temperature and pressure such that both solvents do not boil.

12. The process of claim 1, 2 or 3 whereby the solubility of the second solvent within the first solvent at 25° C. is less than 1 weight percent.

13. The process of claim 1, 2 or 3 whereby the liquid extract of tobacco within the first solvent is provided so as to have a pH of about 7 or more prior to the time that contact thereof with the second liquid solvent is effected.

14. The process of claim 1, 2 or 3 whereby the liquid extract of tobacco within the first solvent is provided so as to have a pH of about 8 or more prior to the time that contact thereof with the second liquid solvent is effected.

15. The process of claim 1, 2 or 3 whereby the liquid extract of tobacco within the first solvent is provided so as to have a pH of about 9 or more prior to the time that contact thereof with the second liquid solvent is effected.

16. A process for providing tobacco extract, the process comprising:

(i) extracting components from tobacco material with a first liquid solvent having an aqueous character, (ii) providing a liquid extract of tobacco within the first solvent and adjusting the pH thereof, (iii) contacting the first solvent and extracted tobacco components therewithin with a second liquid solvent which is immiscible with the first solvent, (iv) subjecting the contacted first and second solvents to conditions sufficient to transfer some tobacco components from with the first solvent to within the second solvent, (v) separating the first and second solvent from one another, and (vi) isolating tobacco components from the first solvent.

17. The process of claim 16 whereby the first solvent is water.

18. The process of claim 16 whereby the second solvent is a halogenated hydrocarbon.

19. The process of claim 16, 17 or 18 whereby the first and second solvents are subjected to conditions sufficient to transfer tobacco components from within the first solvent to within the second solvent at a temperature less than about 30° C. at atmospheric pressure.

20. The process of claim 16, 17 or 18 whereby the density of the second solvent is greater than the density of the first solvent.

21. The process of claim 16, 17 or 18 whereby the density of the second solvent differs from the first solvent by more than 20 percent.

22. The process of claim 16, 17 or 18 whereby the density of the second solvent differs from the first solvent by more than 30 percent.

23. The process of claim 16, 17 or 18 whereby the density of the second solvent differs from the first solvent by more than 40 percent.

24. The process of claim 16 whereby the first solvent is a co-solvent mixture.

25. The process of claim 16 whereby the amount of extracted tobacco components within the first solvent is less than about 10 weight percent.

26. The process of claim 16 whereby the first and second solvents are subjected to conditions sufficient to transfer tobacco components from within the first solvent to within the second solvent at a temperature and pressure such that both solvents do not boil.

27. The process of claim 16, 17 or 18 whereby the solubility of the second solvent within the first solvent at 25° C. is less than 1 weight percent.

28. The process of claim 16, 17 or 18 whereby the liquid extract of tobacco within the first solvent is provided so as to have a pH of about 7 or more prior to the time that contact thereof with the second liquid solvent is effected.

29. The process of claim 16, 17 or 18 whereby the liquid extract of tobacco within the first solvent is provided so as to have a pH of about 8 or more prior to the time that contact thereof with the second liquid solvent is effected.

30. The process of claim 16, 17 or 18 whereby the liquid extract of tobacco within the first solvent is provided so as to have a pH of about 9 or more prior to the time that contact thereof with the second liquid solvent is effected.

31. A process for providing a tobacco extract, the process comprising:

(i) extracting components from tobacco material with a first liquid solvent having an aqueous character,
(ii) providing a liquid extract of tobacco within the first solvent and adjusting the pH thereof,
(iii) contacting the first solvent and extracted tobacco components therewithin with a second liquid solvent which is immiscible with the first solvent,
(iv) subjecting the contacted first and second solvents to conditions sufficient to transfer some tobacco components from with the first solvent to within the second solvent,
(v) separating the first and second solvent from one another, and
(vi) isolating tobacco components from the second solvent.

32. The process of claim 31 whereby the first solvent is water.

33. The process of claim 31 whereby the second solvent is a halogenated hydrocarbon.

34. The process of claim 31 whereby the first solvent is a co-solvent mixture.

35. The process of claim 31, 32 or 33 whereby the density of the second solvent is greater than the density of the first solvent.

36. The process of claim 31, 32 or 33 whereby the density of the second solvent differs from the first solvent by more than 20 percent.

37. The process of claim 31, 32 or 33 whereby the density of the second solvent differs from the first solvent by more than 30 percent.

38. The process of claim 31, 32 or 33 whereby the density of the second solvent differs from the first solvent by more than 40 percent.

39. The process of claim 31, 32 or 33 whereby the first and second solvents are subjected to conditions sufficient to transfer tobacco components from within the first solvent to within the second solvent at a temperature less than about 30° C.

40. The process of claim 31 whereby the amount of extracted tobacco components within the first solvent is less than about 10 weight percent.

41. The process of claim 31 whereby the first and second solvents are subjected to conditions sufficient to transfer tobacco components from within the first solvent to within the second solvent at a temperature and pressure such that both solvents do not boil.

42. The process of claim 31, 32 or 33 whereby the solubility of the second solvent within the first solvent at 25° C. is less than 1 weight percent.

43. The process of claim 31, 32 or 33 whereby the liquid extract of tobacco within the first solvent is provided so as to have a pH of about 7 or more prior to the time that contact thereof with the second liquid solvent is effected.

44. The process of claim 31, 32 or 33 whereby the liquid extract of tobacco within the first solvent is provided so as to have a pH of about 8 or more prior to the time that contact thereof with the second liquid solvent is effected.

45. The process of claim 31, 32 or 33 whereby the liquid extract of tobacco within the first solvent is provided so as to have a pH of about 9 or more prior to the time that contact thereof with the second liquid solvent is effected.

46. The process of claim 1 or 2 whereby components are extracted from the tobacco material with the first solvent at a temperature between about 5° C. and about 60° C.

47. The process of claim 16 or 17 whereby components are extracted from the tobacco material with the first solvent at a temperature between about 5° C. and about 60° C.

48. The process of claim 31 or 32 whereby components are extracted from the tobacco material with the first solvent at a temperature between about 5° C. and about 60° C.

49. A process for removing nicotine from a tobacco extract, the process comprising:

(i) extracting components from tobacco material with a first liquid solvent having an aqueous character,
(ii) providing a liquid extract of tobacco within the first solvent,
(iii) contacting the first solvent and extracted tobacco components therewith with a second liquid solvent which is immiscible with the first solvent,
(iv) subjecting the contacted first and second solvents to conditions sufficient to transfer greater than 90 weight percent of the nicotine from within the first solvent to with the second solvent, and
(v) separating the first and second solvent from one another.

50. The process of claim 49 whereby the liquid extract of tobacco within the first solvent is provided so as to have a pH of about 8 or more prior to the time that contact thereof with the second liquid solvent is effected.

51. The process of claim 49 whereby the liquid extract of tobacco within the first solvent is provided so as to have a pH of about 9 or more prior to the time that contact thereof with the second liquid solvent is effected.

52. The process of claim 49 whereby the solubility of the second solvent within the first solvent at 25° C. is less than 1 weight percent.

53. The process of claim 49 whereby the density of the second solvent is greater than the density of the density of the first solvent.

54. The process of claim 49 whereby the second solvent is monofluorotrichloromethane.

55. The process of claim 49 whereby the first and second solvents are subjected to conditions sufficient to transfer tobacco components from within the first solvent to within the second solvent at a temperature less than about 30° C. at atmospheric pressure.

56. The process of claim 49 further comprising isolating tobacco components from the first solvent after the first and second solvents are separated from one another.

57. The process of claim 49 further comprising isolating tobacco components from the second solvent after the first and second solvents are separated from one another.

58. The process of claim 49 further comprising isolating tobacco components from each of the first and second solvents after the first and second solvents are separated from one another.

59. The process of claim 1 or 16 whereby the tobacco components within the first solvent are isolated according to step (vi) using a spray drying step.

60. The process of claim 49 whereby tobacco components within the first solvent which is obtained in step (v) are isolated using a spray drying step.

* * * * *